United States Patent [19]

Strauss

[11] 3,998,728

[45] Dec. 21, 1976

[54] SETTLING CLASSIFIER FOR SORTING MINERAL RAW MATERIALS

[75] Inventor: Werner Strauss, Bochum, Germany

[73] Assignee: Klockner-Humboldt-Deutz AG, Cologne, Germany

[22] Filed: Mar. 3, 1975

[21] Appl. No.: 555,042

[30] Foreign Application Priority Data

Mar. 2, 1974 Germany ..... 2410112

[52] U.S. Cl. ..... 209/172.5; 209/173

[51] Int. Cl.[2] ..... B03B 5/42

[58] Field of Search ..... 209/172.5, 172, 173

[56] References Cited

FOREIGN PATENTS OR APPLICATIONS

| | | | |
|---|---|---|---|
| 1,120,393 | 12/1961 | Germany | 209/172.5 |
| 46,223 | 4/1964 | Poland | 172.5/ |
| 883,926 | 12/1961 | United Kingdom | 209/172.5 |
| 913,076 | 12/1962 | United Kingdom | 209/172 |

*Primary Examiner*—Frank W. Lutter
*Assistant Examiner*—Ralph J. Hill
*Attorney, Agent, or Firm*—Herbert L. Lerner

[57] ABSTRACT

Settling classifier for sorting mineral raw materials into at least three components includes container means wherein at least two separating baths of different density are received, the container means having a partition therein separating the baths one from another, a bucket wheel coordinated with the container means so as to be in communication with the separating baths and being rotatable in a plane extending parallel to the partition, the bucket wheel having a dividing ring therein operatively engaging the partition and dividing the bucket wheel into parts corresponding to the respective baths, the separating baths having respective elongated quadrilateral surfaces, the longitudinal direction of which extends in axial direction of the rotary bucket wheel.

3 Claims, 2 Drawing Figures

SETTLING CLASSIFIER FOR SORTING MINERAL RAW MATERIALS

Figure 1:
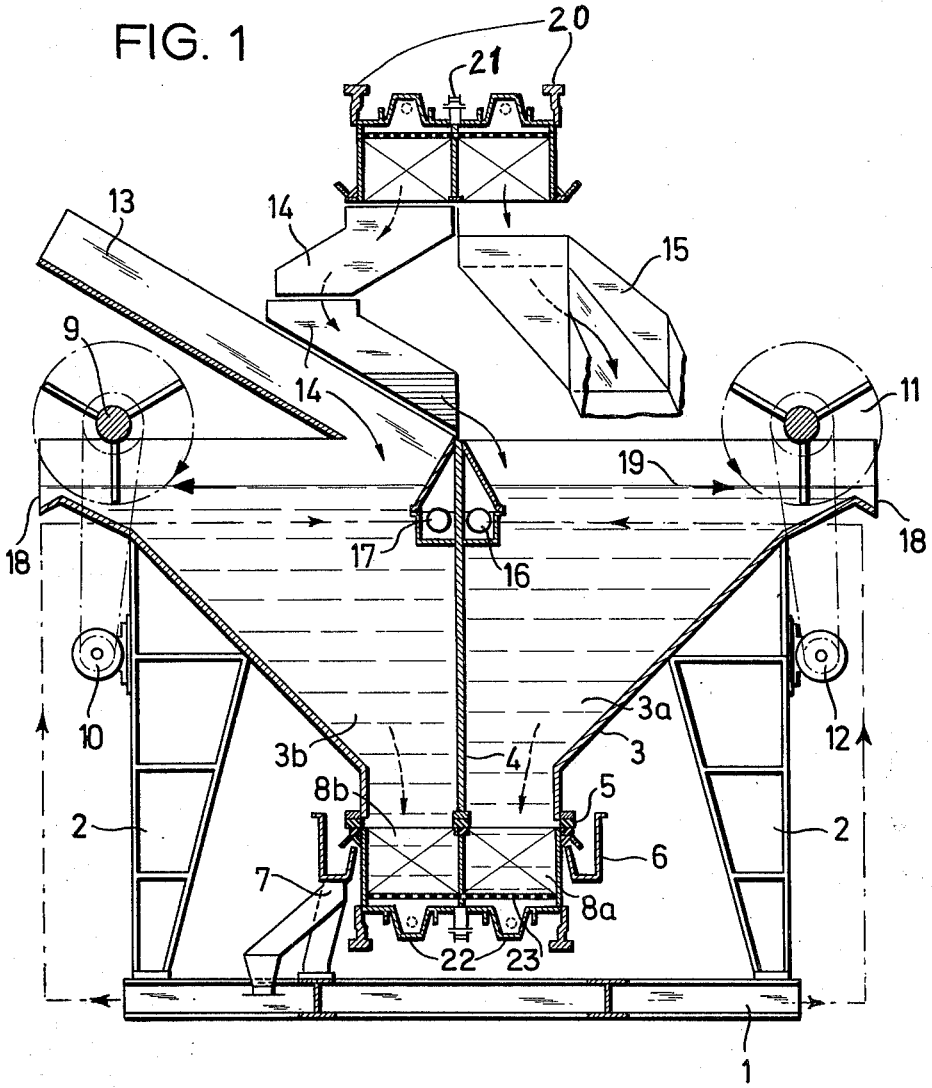

The invention relates to a settling classifier for sorting or separating raw minerals and, more particularly, such a classifier which sorts the raw mineral materials, especially coal or ore, into at least three components in at least two separating baths of different density, the separating baths being closed off from one another by partition which extends parallel to the rotary plane of a bucket wheel and which operatively communicates with respective separate ring-shaped chambers of the bucket wheel, as known heretofore in the art.

In coal dressing or beneficiation technology it has been known heretofore to provide a settling, hydraulic or wet classifier for separating three products wherein two separating baths having stages of different density extend through and beyond the inner diameter of a buck wheel transversely to the rotary plane of the bucket wheel. The depth of the separating baths thereby corresponds to substantially half of the diameter of the bucket wheel. The raw coal, for example, is initially delivered to the separating bath of lesser density, the floating material thereof being then permitted to flow out and the sinking material formed of medium-size grains and recovered mineral matters per se is raised by the bucket wheel as it is rotated and is transferred into the second separating bath of higher density. In the second separating bath of suitably higher density, the medium-size granular material floats on the surface thereof and is permitted to flow out, while the recovered mineral material per se of larger and heavier particles or lumps sinks in the bath into the bucket wheel from which it is subsequently withdrawn.

In a heretofore known settling classifier for sorting raw mineral materials of this general type, the settling classifier has two separating baths, the surfaces of which are substantially square-shaped, the baths being separated one from the other by a partition, the material floating on the surfaces of the baths being discharged therefrom in a direction parallel to the plane in which the bucket wheel is disposed.

It is an object of the invention of the instant application to provide a settling classifier for sorting raw mineral materials which is an improvement over the aforedescribed heretofore known settling classifier and which especially affords higher throughput rates for the equivalent bucket wheel diameter.

With the foregoing and other objects in view, there is provided, in accordance with the invention, a settling classifier for sorting mineral raw materials into at least three components comprising container means wherein at least two separating baths of different density are received, the container means having a partition therein separating the bath one from another, a bucket wheel coordinated with the container means so as to be in communication with the separating baths and being rotatable in a plane extending parallel to said partition, the bucket wheel having a dividing ring therein operatively engaging the partition and dividing the bucket wheel into parts corresponding to the respective baths, the separating baths having respective elongated quadrilateral surfaces, the longitudinal direction of which extends in axial direction of the rotary bucket wheel.

As a result of incorporating these features in the settling classifier, the surface of the separating baths are considerably increased without having to increase the diameter of the bucket wheel, that is for a separating bath having the same width as in the aforedescribed heretofore known settling classifier, and the critical period of duration of the recovered mineral material in the separating bath is correspondingly increased. Thus, raw materials of relatively slight difference in density can be separated sharply one from another, and the occurrence of flowing strands, which can generally occur in baths of relatively shorter length, is reliably avoided. Furthermore, due to the relatively increased size of the surface of the separating baths, they can be provided with suitable stabilizing or pacifying devices.

In accordance with alternate additional features of the invention, the surfaces of the separating baths are provided with substantially rectangular or trapezoidal shape. In this manner, by means which are relatively simple to produce with current production techniques, an advantageous matching or accomodation of the size of the bath surfaces to the various velocities of sinking and separation of the ore or coal mixtures that are to be separated is achieved without requiring the longitudinal extension of the separating baths to be so great that a considerable increase in the space required therefor is necessary.

In accordance with a further feature of the invention, the settling classifier of the invention in the instant application includes means located at the partition for supplying material to be separated to the baths, and means located at a side of the separated baths distant from the partition, for discharging at least one component of the material from the baths. In this manner, there is provided very advantageously optimal utilization of the surface of the baths, because all components of the product to be separated must thereby travel across the entire length of the respective baths in order to reach the material discharge means from the material supply means. Thus, an especially good separation or classification is attained because correspondingly lengthy durations or periods during which separation occurs are thereby achieved.

In accordance with yet another feature of the invention, the settling classifier is constructed so that the material component discharging from the discharge means is dischargeable therefrom in a direction corresponding to the axial direction of the rotary bucket wheel. In this manner, the flows of material within the separating baths are not required to endure any changes in direction but rather, move without diversion or deviation from the material supply means to the material discharge means, and also maintain this movement thereof as they pass through and out of the material discharge means. Therefore, corner vortices or similar impediments to flow cannot occur. This is especially important for relatively large quantities of material for which the settling classifier of the invention of the instant application is especially intended.

In accordance with an added feature of the invention, the settling classifier includes means for supplying separating bath media (turbid material) to the baths, located in vicinity of the material supplying means at the partition. The resulting advantage of this feature is that the movement of the material from the material supplying means, which is also located at the partition, is aided by the introduction of the turbid material and, furthermore, the initial settling movements occur within the fresh, newly supplied turbid material.

In accordance with a concomitant feature of the invention, sludge collecting troughs are located at the outside of the bucket wheel for collecting therein any sludge escaping from the baths. In this manner, in relatively large constructions of this type of settling classifier according to the invention of the instant application, no large quantity of turbid material can escape from the seals between the bath container and the bucket wheel into the workroom and, furthermore, no great loss of turbid material can occur, but rather, an immediate return of the turbid material circulatory loop is achieved.

Other features which are considered as characteristic for the invention are set forth in the appended claims.

Although the invention is illustrated and described herein as embodied in settling classifier for sorting mineral raw materials, it is nevertheless not intended to be limited to the details shown, since various modifications and structural changes may be made therein without departing from the spirit of the invention and within the scope and range of equivalents of the claims.

Figure 2:
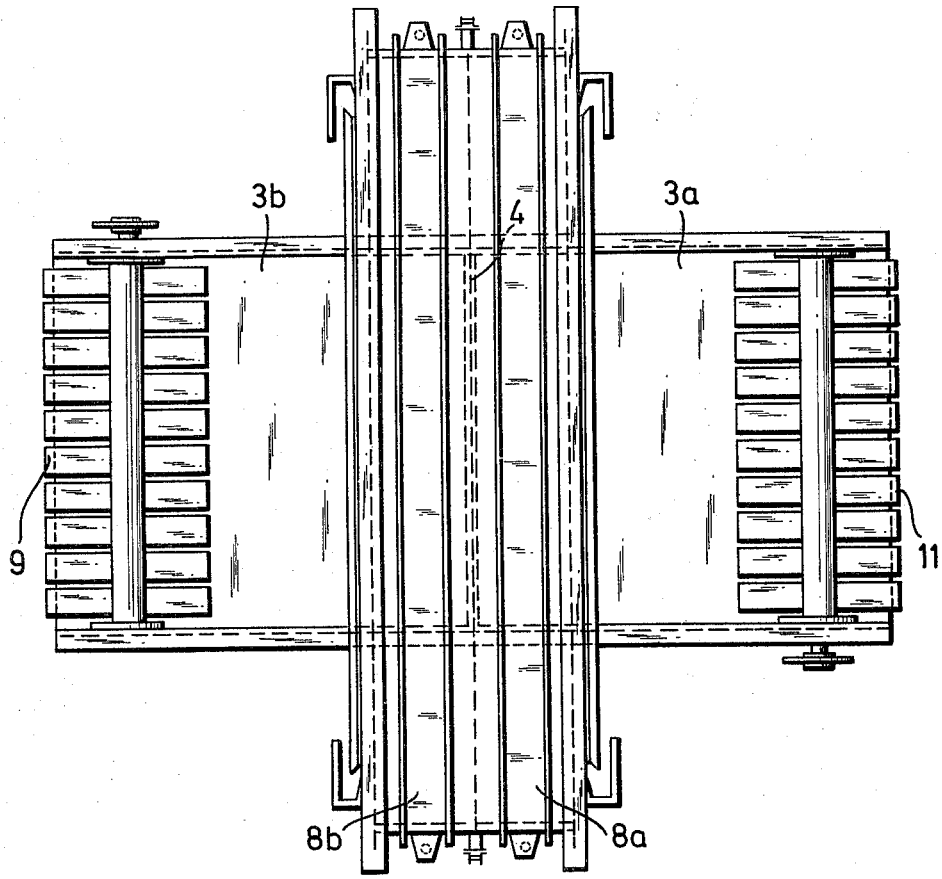

The construction and method of the invention, however, together with additional objects and advantages thereof will be best understood from the following description of specific embodiments when read in connection with the accompanying drawings, in which:

FIG. 1 is a diagrammatic vertical sectional view of a settling classifier for sorting mineral raw material constructed in accordance with the invention; and FIG. 2 is a top plan view of FIG. 1 with the upper slides or chutes omitted.

Referring now to the drawing and first, particularly to FIG. 1 thereof, there is shown a settling classifier according to the invention of the instant application, which is used especially for separating coal. The settling classifier of FIG. 1 is mounted on a foundation and has lateral supports 2 which carry a housing 3 which is divided by a center partition 4 in the interior thereof into two separating baths 3*a* and 3*b*, the respective contents of which have turbidities of different density. At the lower outer edge of the separating bath housing 3, seals 5 are provided between the housing 3 and a bucket wheel 8*a*, 8*b*. The bucket wheel 8*a*, 8*b* is a circular trough having non-illustrated transverse walls disposed peripherally therein at given spacing so as to form "buckets" therein, and having the openings thereof on the radially inner side thereof. At the radially outer side of the bucket wheel 8*a*, 8*b*, respective annular troughs 22 are formed below an overlying screen 23 which retains thereabove the heavier and larger mineral material per se while permitting the liquid and smaller particles to accumulate in the troughs 22. The liquid content of the baths 3*a* and 3*b* which passed through the screen 23 together with any solid particles or turbid material may then be recirculated to the sludge circuit. so as to return the same, if desired through respective sludge inlets 16 and 17 to the respective baths 3*a* and 3*b*. The bucket wheel 8*a*, 8*b* is guided between circular rail members 20 which are suitably affixed to a non-illustrated support, and the bucket wheel is rotatable by, for example, a driven crown gear 21 or the like, which meshes with a corresponding circular gearing formed at the outside of the bucket wheel, or may be driven by any other suitable conventional means.

Externally disposed capture or collection troughs 6 are provided for turbid substance or sludge which have a sludge line 7 that returns to the sludge circuit. The fines of lesser density floating on the surface of the liquid in the separating vessel are discharged at the side of the sludge vessel distant from the partition 4, by means of a transfer device 9, in the form of a series of paddle members mounted on a common shaft and rotatably driven by a motor 10. A transfer device 11 of similar construction to that of the transfer device 9 and driven by a motor 12 similarly accounts for the discharge of medium-size granular material at the other side of the settling classifier. The supply of the material to be classified is provided through a material addition or supply 13 at the partition 4, and the transfer of the medium-size granular material which has sunken into the bucket wheel part of 8*b* and of the material from a non-illustrated supply dump, to the second separating side is effected by a slide 14 which introduces the medium-size granular material and the material from the supply pile into the second separating stage from above the partition 4. A transfer device 15 for the large-particle material matter per se accumulating in the bucket wheel part 8*a* is located above the second separating bath 3*a*. The aforementioned feeders 16 and 17 are located on both sides of the partition 4 just below the turbid material or sludge floating on the surface of the liquid.

In the top plan view of FIG. 2, the elongated quadrilateral and, in fact, rectangular shape of the surface of the sludge vessel 3 is clearly shown. The material transfer devices 9 and 11 are also shown at the locations thereof at opposite sides of the sludge vessel 3.

The function of the settling classifier in effecting the separation of three products when classifying coal is as follows:

The material to be separated is intially introduced through the material addition or supply 13 in the vicinity of the partition and into the first bath 3*b* with a relatively low specific weight. In the case of coal, the specific weight is, for example $\gamma = 1.4$. The mineral material per se and medium-sized granular material sink and are collected in the bucket wheel part 8*b*, while the fines are displaced on the surface of the turbid liquid to the material transfer device 9 at which the housing 3 is provided with a throw-off edge 18. This displacement of the fines is assisted by the introduction of the turbid substance or sludge through the sludge inlet 17 in the vicinity of the partition 4 just below the surface of the sludge bath 3*b*. The sunken medium-size granular material and the mineral matter per se are conducted upwardly by the bucket wheel part 8*b* and, shortly before the upper point of the bucket wheel movement is reached, shown at the top of FIG. 2, are transferred into the slide 14, which leads to the second sludge bath 3*a* with considerably greater specific weight. For coal, the specific weight is, for example, $\gamma = 1.8$. In the second bath 3*a*, the mineral material per se separate by sinking downwardly and collecting in the bucket wheel part 8*a*, while the medium-size granular material on the surface of the turbid bath 3*a* is advanced to the transfer device 11 and the throw-off edge 18. The bucket wheel part 8*a* conducts the sunken material matter per se up to the vicinity of the uppermost point of travel of the bucket wheel part 8*a* and transfers it thereat to the mineral matter transfer device 15, which discharges the mineral matter at a location beyond the surface of the bath 3*a*. In this manner, separation of the material introduced through the material addition or supply 13 into fines that are discharged through the transfer device 9, medium-size granular material that is discharged through the transfer device 11 and mineral matter per se that is discharged through the transfer device 15.

During the movement of the bucket wheels 8*a*, 8*b*, the stationary housing 3 for the turbid material is sealed with respect to the bucket wheel 8 by means of the seal 5, any turbid material or sludge penetrating therethrough being collected in the capture of collection trough 6 and returned through the removal line 7 to the circulatory loop of the turbid material.

The settling classifier constructed in accordance with the invention is especially suited for large throughput rates, because the heretofore-known settling classifiers of this general type had reached their upper construction or design limits at an output or capacity of about 200 tons per hour. For greater capacities the diameter of the bucket wheel would have had to be increased to too great an extent. With a settling classifier according to the instant application, up to 500 tons of coal per hour can be separated or classified without having to increase the diameter of the bucket wheel too greatly. The separation or classification performed by the settling classifier of the invention in the instant application can also take place into various components of ores or minerals, because, due to the device of the invention a considerable increase in the area of the separating bath surfaces is possible. Furthermore, the addition of chemicals as well as the installation of stabilizing or pacifying plates or the like are possible.

It is claimed:

1. Settling classifier for sorting mineral raw materials into at least three components comprising container means wherein at least two separating baths of different density are received, said container means having a partition therein separating said baths one from another, a bucket wheel coordinated with said container means so as to be in communication with said separating baths and being rotatable in a plane extending parallel to said partition, said bucket wheel having a dividing ring therein operatively engaging said partition and dividing said bucket wheel into parts corresponding to the respective baths, said separating baths having respective elongated quadrilateral surfaces, the longitudinal direction of which extends in axial direction of the rotary bucket wheel, means located at said partition for supplying material to be separated to said container means, and means located at a side of said separated baths distant from said partition, for discharging at least one component of the material from said baths and means for supplying bath media to said baths located in vicinity of said material supplying means at said partition.

2. Settling classifier for sorting mineral raw materials into at least three components comprising container means wherein at least two separating baths of different density are received, said container means having a partition therein separating said baths one from another, a bucket wheel coordinated with said container means so as to be in communication with said separating baths and being rotatable in a plane extending parallel to said partition, said bucket wheel having a dividing ring therein operatively engaging said partition and dividing said bucket wheel into parts corresponding to the respective baths, sludge collecting troughs located at the outside of said bucket wheel for collecting therein any sludge escaping from said baths, said separating baths having respective elongated quarilateral surfaces, the longitudinal direction of which extends in axial direction of the rotary bucket wheel.

3. Settling classifier according to claim 1 including means connecting said sludge collecting troughs with said bath media supplying means for recirculating said escaped sludge to said baths.

* * * * *